US008712299B2

(12) United States Patent
Sugita et al.

(10) Patent No.: US 8,712,299 B2
(45) Date of Patent: Apr. 29, 2014

(54) IMAGE FORMING APPARATUS HAVING A PRIMARY TRANSFER UNIT, A SECONDARY TRANSFER UNIT, AND A DIRECT TRANSFER UNIT

(75) Inventors: Narumi Sugita, Kanagawa (JP); Toshiyuki Uchida, Kanagawa (JP); Yohei Miura, Tokyo (JP); Keisuke Sugiyama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 592 days.

(21) Appl. No.: 13/029,391

(22) Filed: Feb. 17, 2011

(65) Prior Publication Data

US 2011/0206423 A1 Aug. 25, 2011

(30) Foreign Application Priority Data

Feb. 23, 2010 (JP) ..... 2010-037692

(51) Int. Cl.
*G03G 15/20* (2006.01)

(52) U.S. Cl.
USPC ..... 399/312; 399/313; 399/316; 399/317; 399/381; 399/388; 399/394; 399/395; 399/397; 430/47.1; 430/47.2; 430/47.3; 430/47.4; 430/47.5; 430/48; 347/116

(58) Field of Classification Search
USPC ..... 399/312, 300, 316, 317, 397; 430/47.4, 430/47.5
See application file for complete search history.

(56) References Cited

U.S. PATENT DOCUMENTS 5,075,730 A * 12/1991 Hoshi ..... 399/302
6,949,896 B2 9/2005 Andoh et al.
7,110,700 B2 9/2006 Andoh et al.
7,206,537 B2 4/2007 Funamoto et al.
7,215,907 B2 5/2007 Fukuchi et al.
7,228,088 B2 * 6/2007 Shimmura ..... 399/101
7,242,883 B2 7/2007 Miura (Continued)

FOREIGN PATENT DOCUMENTS

JP 2000-122508 A 4/2000
JP 2003-270891 A 9/2003

(Continued)

OTHER PUBLICATIONS

U.S. Appl. No. 12/962,078, filed Dec. 7, 2010, Sugiyama, et al.

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

An image forming apparatus includes: a first image carrier; a first image forming unit that forms an image; an intermediate transfer belt; a primary transfer unit that primarily transfers the image onto the intermediate transfer belt; a secondary transfer unit that secondarily transfers the image transferred further onto a recording medium; a second image carrier that transfers the image onto the recording medium; a second image forming unit that forms an image on the second image carrier; a direct transfer unit that directly transfers the image onto the recording medium; a recording medium carriage belt, and a driving roller that drives the recording medium carriage belt; a speed fluctuation detecting unit; and a drive control unit that controls driving of the driving roller so as to reduce the cyclic speed fluctuation of the carriage belt based on a detection result of the speed fluctuation detecting unit.

10 Claims, 5 Drawing Sheets

(56) References Cited

U.S. PATENT DOCUMENTS

| | | | | |
|---|---|---|---|---|
| 7,251,444 | B2 | 7/2007 | Matsuda et al. | |
| 7,257,339 | B2 | 8/2007 | Yokoyama et al. | |
| 7,330,009 | B2 | 2/2008 | Andoh et al. | |
| 7,352,978 | B2 | 4/2008 | Ebara et al. | |
| 7,369,795 | B2 | 5/2008 | Funamoto et al. | |
| 7,373,093 | B2 | 5/2008 | Shinohara et al. | |
| 7,376,375 | B2 | 5/2008 | Kobayashi et al. | |
| 7,376,376 | B2 | 5/2008 | Ebara et al. | |
| 7,386,262 | B2 | 6/2008 | Okamura et al. | |
| 7,454,150 | B2 | 11/2008 | Matsuda et al. | |
| 7,463,855 | B2 * | 12/2008 | Shimmura | 399/298 |
| 7,509,074 | B2 | 3/2009 | Yokoyama et al. | |
| 7,532,842 | B2 | 5/2009 | Handa et al. | |
| 7,603,061 | B2 | 10/2009 | Ebara et al. | |
| 7,630,657 | B2 | 12/2009 | Ehara et al. | |
| 7,653,332 | B2 | 1/2010 | Ehara et al. | |
| 7,693,468 | B2 | 4/2010 | Ehara et al. | |
| 7,697,867 | B2 | 4/2010 | Ehara et al. | |
| 7,706,731 | B2 * | 4/2010 | Martin et al. | 399/298 |
| 7,729,024 | B2 | 6/2010 | Kobayashi et al. | |
| 7,748,695 | B2 | 7/2010 | Miura et al. | |
| 7,773,914 | B2 | 8/2010 | Funamoto et al. | |
| 7,796,906 | B2 * | 9/2010 | Yabuta | 399/66 |
| 7,796,929 | B2 | 9/2010 | Ebara et al. | |
| 7,800,335 | B2 | 9/2010 | Andoh et al. | |
| 7,885,577 | B2 | 2/2011 | Sugiyama | |
| 7,917,060 | B2 | 3/2011 | Miura | |
| 7,929,894 | B2 | 4/2011 | Murata et al. | |
| 7,937,007 | B2 | 5/2011 | Kobayashi et al. | |
| 7,941,082 | B2 * | 5/2011 | Kosako et al. | 399/301 |
| 8,180,246 | B2 * | 5/2012 | Kawahara et al. | 399/101 |
| 8,229,335 | B2 * | 7/2012 | Nishizaki | 399/301 |
| 8,249,468 | B2 * | 8/2012 | Kuma et al. | 399/21 |
| 8,260,179 | B2 * | 9/2012 | Miura et al. | 399/298 |
| 8,290,413 | B2 * | 10/2012 | Kobayashi et al. | 399/299 |
| 8,311,464 | B2 * | 11/2012 | Kawase et al. | 399/301 |
| 8,315,545 | B2 * | 11/2012 | Sudo et al. | 399/301 |
| 8,320,799 | B2 * | 11/2012 | Yoshida et al. | 399/258 |
| 8,331,836 | B2 * | 12/2012 | Kamekura et al. | 399/301 |
| 8,335,446 | B2 * | 12/2012 | Kobayashi et al. | 399/66 |
| 8,364,063 | B2 * | 1/2013 | Ishii et al. | 399/301 |
| 8,369,756 | B2 * | 2/2013 | Kosako et al. | 399/301 |
| 8,385,793 | B2 * | 2/2013 | Furuya et al. | 399/302 |
| 8,422,897 | B2 * | 4/2013 | Suzuki et al. | 399/49 |
| 8,437,671 | B2 * | 5/2013 | Miyakawa et al. | 399/316 |
| 8,446,597 | B2 * | 5/2013 | Enami et al. | 358/1.12 |
| 8,521,046 | B2 * | 8/2013 | Sugiyama et al. | 399/49 |
| 2006/0062608 | A1 * | 3/2006 | Shimmura | 399/298 |
| 2006/0133873 | A1 | 6/2006 | Andoh et al. | |
| 2006/0188299 | A1 * | 8/2006 | Matsumoto | 399/302 |
| 2007/0014596 | A1 * | 1/2007 | Sohmiya et al. | 399/307 |
| 2007/0120933 | A1 * | 5/2007 | Mueller | 347/103 |
| 2008/0131168 | A1 | 6/2008 | Ehara et al. | |
| 2008/0213000 | A1 | 9/2008 | Funamoto et al. | |
| 2008/0240754 | A1 | 10/2008 | Kobayashi et al. | |
| 2009/0017953 | A1 | 1/2009 | Uehara et al. | |
| 2009/0074506 | A1 | 3/2009 | Sugiyama et al. | |
| 2009/0169259 | A1 | 7/2009 | Ebara et al. | |
| 2009/0263158 | A1 | 10/2009 | Murata et al. | |
| 2010/0061752 | A1 * | 3/2010 | Sudo et al. | 399/66 |
| 2010/0266299 | A1 | 10/2010 | Funamoto et al. | |
| 2010/0310281 | A1 | 12/2010 | Miura et al. | |
| 2010/0322679 | A1 * | 12/2010 | Kobayashi et al. | 399/301 |
| 2011/0043588 | A1 * | 2/2011 | Shukuya | 347/116 |
| 2011/0229219 | A1 * | 9/2011 | Kobayashi et al. | 399/301 |
| 2012/0027464 | A1 * | 2/2012 | Kobayashi et al. | 399/167 |
| 2013/0011171 | A1 * | 1/2013 | Tamura et al. | 399/321 |

FOREIGN PATENT DOCUMENTS

| | | | |
|---|---|---|---|
| JP | 2006-085138 | A | 3/2006 |
| JP | 2006-201743 | A | 8/2006 |
| JP | 2007-226206 | A | 9/2007 |
| JP | 2008-112132 | A | 5/2008 |
| JP | 2010-281943 | A | 12/2010 |
| JP | 2011-18019 | A | 1/2011 |

OTHER PUBLICATIONS

U.S. Appl. No. 13/036,553, filed Feb. 28, 2011, Kobayashi, et al.
Office Action issued Sep. 27, 2013 in Japanese Patent Application No. 2010-037692.

* cited by examiner

IMAGE FORMING APPARATUS HAVING A PRIMARY TRANSFER UNIT, A SECONDARY TRANSFER UNIT, AND A DIRECT TRANSFER UNIT

CROSS-REFERENCE TO RELATED APPLICATIONS

The present application claims priority to and incorporates by reference the entire contents of Japanese Patent Application No. 2010-037692 filed in Japan on Feb. 23, 2010.

BACKGROUND OF THE INVENTION

1. Field of the Invention

The present invention relates to an image forming apparatus such as a printer, a facsimile, and a copying machine.

2. Description of the Related Art

Conventionally, an image forming apparatus including a plurality of image forming units that form images of a plurality of colors including black onto corresponding image carriers has been known, as disclosed in Japanese Patent Application Laid-open No. 2006-201743, for example.

The image forming apparatus disclosed in Japanese Patent Application Laid-open No. 2006-201743 includes a direct transfer position where a black image formed in a black image forming unit is directly transferred onto a recording medium, and a secondary transfer position where images of the other colors primarily transferred onto an intermediate transfer belt from the image forming units of the other colors are secondarily transferred onto the recording medium. The secondary transfer position is located upstream of the direct transfer position in a recording medium conveying direction. The intermediate transfer belt is rotatably stretched across a plurality of roller members, and a driving roller that is one of the roller members drives the intermediate transfer belt in rotation. A recording medium carriage belt for carrying and conveying the recording medium along a path passing through the direct transfer position and the secondary transfer position is rotatably stretched across a plurality of roller members including a recording medium carriage belt driving roller. In the image forming apparatus disclosed in Japanese Patent Application Laid-open No. 2006-201743, the recording medium carriage belt carries the recording medium through the secondary transfer position and the direct transfer position, so that the black image is superimposed at the direct transfer position over the images of the other colors that have been transferred onto the recording medium at the secondary transfer position so as to form a full color image on the recording medium. Furthermore, by conveying the recording medium in a manner carried on the recording medium carriage belt, fluctuations in a recording medium conveying path between the secondary transfer position and the direct transfer position can be suppressed, and the recording medium can be stably conveyed between the secondary transfer position and the direct transfer position.

In the image forming apparatus disclosed in Japanese Patent Application Laid-open No. 2006-201743, speed fluctuations, which are in the rotation cycle of the recording medium carriage belt driving roller due to factors such as decentering or fluctuating load of the recording medium carriage belt driving roller, cause the rotation speed of the recording medium carriage belt to fluctuate cyclically. In addition, the conveying speed of the recording medium, which is conveyed in the manner carried on the recording medium carriage belt, also fluctuates following the rotation speed of the recording medium carriage belt. Therefore, the conveying speed of the recording medium carried and conveyed on the recording medium carriage belt also fluctuates cyclically, in the same manner as the speed of the recording medium carriage belt. If such speed fluctuations occur in the conveying speed of the recording medium, and if the phase of the fluctuations of the conveying speed of the recording medium is different at the secondary transfer position and at the direct transfer position, the cyclical speed fluctuations of the recording medium carriage belt cause a positional deviation between the images of the other colors and the black image transferred at the secondary transfer position and the direct transfer position, respectively, onto the recording medium.

Furthermore, even if the secondary transfer position is located downstream of the direct transfer position in the recording medium conveying direction, the cyclical speed fluctuations of the recording medium carriage belt cause a positional deviation between the black image and the images of the other colors transferred at the direct transfer position and the secondary transfer position, respectively, onto the recording medium.

To address this issue, the applicant of the present application proposed an image forming apparatus disclosed in Japanese Patent Application No. 2009-133931 (hereinafter, referred to as a "previous application").

The image forming apparatus disclosed in the previous application includes a direct transfer position where a black image formed in a black image forming unit is directly transferred onto a recording medium, and a secondary transfer position where images of the other colors, primarily transferred from image forming units of the other colors onto an intermediate transfer belt, are secondarily transferred onto the recording medium. The secondary transfer position is located upstream or downstream of the direct transfer position in the recording medium conveying direction. The intermediate transfer belt is rotatably stretched across a plurality of roller members including an intermediate transfer belt driving roller. A recording medium carriage belt for carrying and conveying the recording medium along a path passing through the direct transfer position and the secondary transfer position is rotatably stretched across a plurality of roller members including a recording medium carriage belt driving roller. The interval between the direct transfer position and the secondary transfer position is set to a positive integral multiple of the circumferential length of the recording medium carriage belt driving roller.

In this manner, the phases of the cyclic speed fluctuations of the recording medium carriage belt at the rotation cycle of the recording medium carriage belt driving roller can be synchronized at the direct transfer position and the secondary transfer position; and the phases of the cyclic speed fluctuations of the recording medium, conveyed in the manner carried on the recording medium carriage belt, can be synchronized at the direct transfer position and the secondary transfer position. Therefore, the impact of the cyclic speed fluctuations of the recording medium carriage belt on the conveying speed of the recording medium can be cancelled out between the direct transfer position and the secondary transfer position. Thus, the positional deviation occurs in the images transferred onto the recording medium at the direct transfer position and the secondary transfer position because of the cyclic speed fluctuations of the recording medium carriage belt can be suppressed.

However, a limitation is imposed on the image forming apparatus disclosed in the previous application, because the interval between the direct transfer position and the secondary transfer position must be a positive integral multiple of the circumferential length of the recording medium carriage belt driving roller. The limitation makes it difficult to reduce the interval between the direct transfer position and the secondary transfer position and to reduce the size of the image forming apparatus.

SUMMARY OF THE INVENTION

It is an object of the present invention to at least partially solve the problems in the conventional technology.

According to an aspect of the present invention, there is provided an image forming apparatus including: a first image carrier; a first image forming unit that forms an image on the first image carrier; an intermediate transfer belt on which the image formed on the first image carrier is primarily transferred; a primary transfer unit that primarily transfers the image formed on the first image carrier onto the intermediate transfer belt; a secondary transfer unit that secondarily transfers the image transferred onto the intermediate transfer belt further onto a recording medium; a second image carrier that is arranged upstream or downstream of a secondary transfer position, where the image is transferred from the intermediate transfer belt onto the recording medium, in a recording sheet conveying direction; a second image forming unit that forms an image on the second image carrier; a direct transfer unit that directly transfers the image formed on the second image carrier onto the recording medium; a recording medium carriage belt that carries and conveys the recording medium so as to for the recording medium to pass through a direct transfer position where the image is directly transferred from the second image carrier onto the recording medium and the secondary transfer position, and that is rotatably stretched across a plurality of roller members; a driving roller that is one of the roller members that stretch the recording medium carriage belt, and that drives the recording medium carriage belt in rotation; a speed fluctuation detecting unit that detects a cyclic speed fluctuation of the recording medium carriage belt; and a drive control unit that controls driving of the driving roller so as to reduce the cyclic speed fluctuation of the recording medium carriage belt based on a detection result of the speed fluctuation detecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

A first embodiment of the present invention applied to a color laser printer (hereinafter, simply referred to as a "printer") that is an electrophotographic image forming apparatus is described below.

Figure 2:
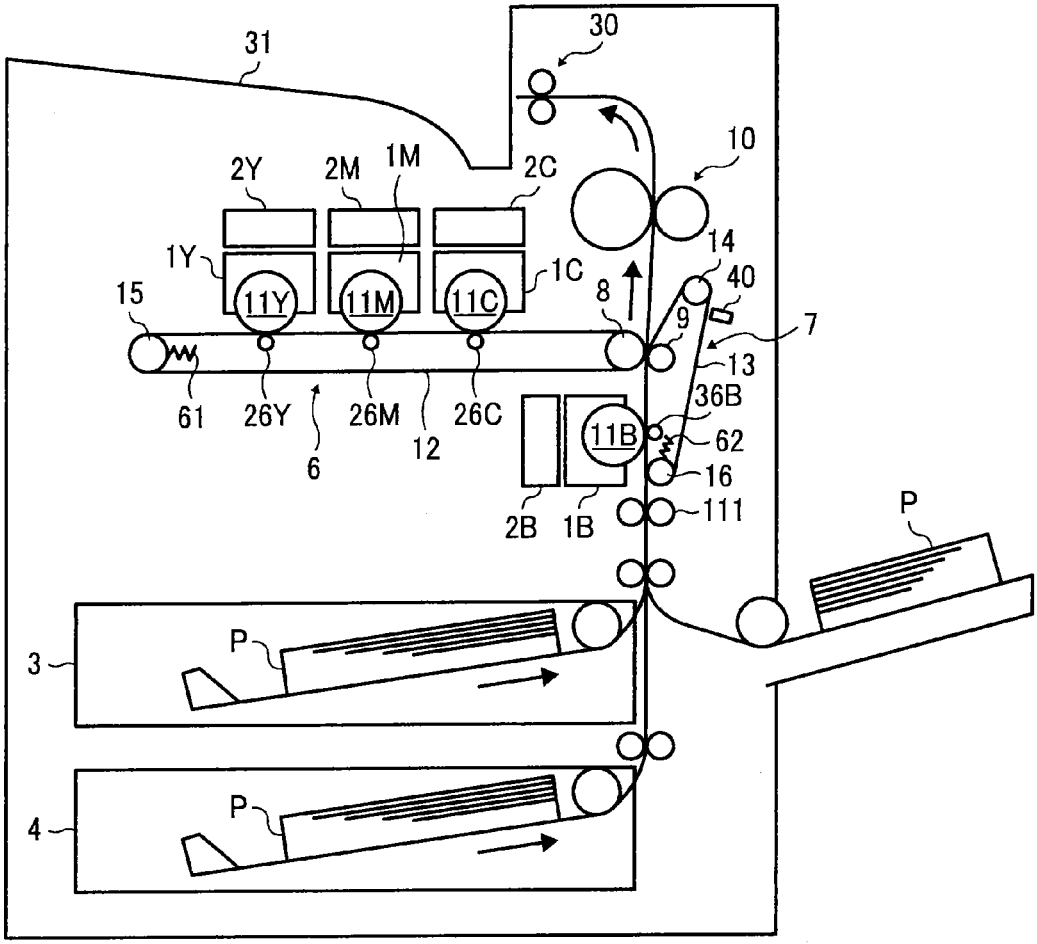
FIG. 2 is a schematic of a structure of the image forming apparatus according to the first embodiment.

FIG. 2 is a schematic of a structure of a printer according to the first embodiment. In FIG. 2, the printer includes a printer unit.

The printer unit includes four image forming units 1Y, 1M, 1C, and 1B that form toner images in yellow, magenta, cyan, and black (hereinafter, denoted as Y, M, C, and B) respectively. An intermediate transfer unit 6 included in the printer unit has an intermediate transfer belt 12 stretched across three primary transfer rollers 26Y, 26M, and 26C along a horizontal direction, and a driving roller 8 and a tension roller 15 arranged inside of the loop of the intermediate transfer belt 12. The tension roller 15 is reciprocally supported about a shaft, and is biased by a spring 61 in the direction from inside to outside of the intermediate transfer belt so as to apply a tensile force to the intermediate transfer belt 12. The intermediate transfer belt 12 that is an image carrier is caused to move endlessly in the counterclockwise direction in FIG. 2 by driving rotations of the driving roller 8. The three image forming units 1Y, 1M, and 1C are arranged side by side along a stretched surface of the intermediate transfer belt 12.

The image forming units 1Y, 1M, 10, and 1B hold respective drum-shaped photosensitive elements 11Y, 11M, 11C, and 11B, a charging unit (not illustrated), a developing unit (not illustrated), and a drum cleaning unit (not illustrated) in a common holding body as a single unit; and these units are integrally mounted on and removed from the housing of the printer unit. The charging units uniformly charge the respective circumferential surfaces of the photosensitive elements 11Y, 11M, 11C, and 11B driven to rotate by a driving unit not illustrated, so as to be charged to the polarity opposite to the polarity of the charged toner in the darkness.

Optical writing units 2Y, 2M, 2C, and 2B are arranged above the image forming units 1Y, 1M, and 1C, respectively, and on the left side of the image forming unit 1B. Color image information sent from an external personal computer not illustrated is discomposed into Y information, M information, C information, and B information in an image processing unit not illustrated, and processed in the printer unit. Based on the color-discomposed image information of Y, M, C, or B, each of the optical writing units 2 drives a light source, not illustrated, using a known technology to generate a Y, an M, a C, or a B writing light beam. The circumferential surfaces of the photosensitive elements 11Y, 11M, 11C, and 11B uniformly charged by the charging units are scanned by the Y, M, C, and B writing light beams. In this manner, Y, M, C, and B electrostatic latent images are formed on the circumferential surfaces of the photosensitive elements 11Y, 11M, 11C, and 11B, respectively. Examples of the light source of the writing light beam include a laser diode and a light emitting diode (LED).

The electrostatic latent images formed on the circumferential surfaces of the photosensitive elements 11Y, 11M, 11C, and 11B are developed into Y, M, C, and B toner images by the developing units, respectively, performing known two-component development using two-component developer containing toner and carrier. However, as the developing units, used instead may be ones adopting known single-component development using single-component developer containing toner.

Amongst the four photosensitive elements, the photosensitive elements 11Y, 11M, and 11C for Y, M, and C are kept in contact with the intermediate transfer belt 12, thereby forming primary transfer nips for Y, M, and C. The primary transfer rollers 26Y, 26M, and 26C pressing the intermediate transfer belt 12 against the photosensitive elements 11Y, 11M, and 11C for Y, M, and C are arranged inside of the loop of the intermediate transfer belt 12. A primary transfer bias is applied to each of the primary transfer rollers 26Y, 26M, and 26C to form a transfer electrical field in each of the primary transfer nips for Y, M, and C. The Y, M, and C toner images, which are formed on the respective circumferential surfaces of the photosensitive elements 11Y, 11M, and 11C, are transferred onto the outer surface of the intermediate transfer belt 12 (the outer surface of the loop) and superimposed over one another in the primary transfer nips for Y, M, and C by the actions of transfer electrical fields and pressures in the nips. In this manner, a three-color superimposed toner image is formed on the outer surface of the intermediate transfer belt 12.

A direct transfer unit 7 is arranged on the right side of the intermediate transfer belt 12 in FIG. 2. The direct transfer unit 7 includes an endless recording sheet carriage belt 13. The recording sheet carriage belt 13 is stretched across a secondary transfer roller 9, a driving roller 14, a tension roller 16, and a transfer roller 36B for B in a vertically elongated manner, and is caused to move endlessly in the clockwise direction in FIG. 2 by driving rotations of the driving roller 14. The tension roller 16 is reciprocally supported about a shaft, and is biased by a spring 62 in the direction from inside to outside of the recording medium carriage belt to apply a tensile force to the recording sheet carriage belt 13. The part of the recording sheet carriage belt 13 wound around the secondary transfer roller 9 is kept in contact with the part of the intermediate transfer belt 12 wound around the driving roller 8 to form a secondary transfer nip. A secondary transfer bias is applied to the secondary transfer roller 9 to form a transfer electrical field in the secondary transfer nip. The part of the recording sheet carriage belt 13, which is wound around the transfer roller 36B for B, is kept in contact with the photosensitive element 11B so as to form a direct transfer nip for B. A transfer bias is applied to the transfer roller 36B, in the same manner as to the primary transfer rollers 26Y, 26M, and 26C, so as to form a transfer electrical field in the direct transfer nip for B.

In the lower part of the housing of the printer unit, a first paper cassette 3 and a second paper cassette 4 are arranged in a manner stacked in a vertical direction. Each of the paper cassettes feeds recording sheets P stored therein out to a sheet conveying path. The recording sheet P thus fed abuts against a pair of registration rollers 111 which are arranged in the sheet conveying path extending in the vertical direction in the printer unit so as to have the skew thereof corrected; and the recording sheet P is nipped between the registration rollers 111. The registration rollers 111 then convey the recording sheet P to the higher position at a predetermined operational timing.

The recording sheet P conveyed out of the registration rollers 111 sequentially passes through the direct transfer nip for B and then the secondary transfer nip for Y, M, and C formed along the sheet conveying path. As the recording sheet P passes through the direct transfer nip for B, the B toner image formed on the circumferential surface of the photosensitive element 11B is transferred onto the recording sheet P by the actions of the transfer electrical field and the pressure in the nip. As the recording sheet P passes through the secondary transfer nip subsequently, a three-color (Y, M, and C) superimposed toner image formed on the intermediate transfer belt 12 is altogether secondarily transferred onto the B toner image that is previously transferred onto the recording sheet P by the actions of the transfer electrical field and the pressure in the nip. In this manner, a full-color image that is a four-color superimposed toner image of Y, M, C, and B is formed on the surface of the recording sheet P.

The transfer residual toner, which is attached on the photosensitive elements 11Y, 11M, 11C, and 11B after the transfer sheet P having passed through the primary transfer nips for Y, M, C and the direct transfer nip for B, is removed by the corresponding drum cleaning units. The drum cleaning units used for Y, M, C, and B may be those that scrub off the toner using a cleaning blade, or those that scrub off the toner using a fur brush roller, or may be those that use magnetic brush cleaning.

A fixing unit 10, having a fixing nip formed between a heating roller and a pressing roller kept in contact therewith, is arranged above the secondary transfer nip. The recording sheet P passed through the secondary transfer nip is sent into the fixing nip included in the fixing unit 10, and applied with a fixing process in which the full-color image is fixed onto the recording sheet P by means of heat and a pressure. The recording sheet P then passes through a discharging path, and discharged onto and stacked on a discharge tray 31 arranged on the top surface of the housing of the printer unit via a pair of discharging rollers 30.

When this printer is operated in a monochromatic mode for forming a monochromatic image, the optical writing unit 2B optically scans the photosensitive element 11B for B, based on monochromatic image data received from an external personal computer and the like not illustrated, and a B electrostatic latent image thus formed is developed into a B toner image in the developing unit for B. The B toner image is then directly transferred onto the recording sheet P in the direct transfer nip for B, and fixed onto the recording sheet P in the fixing unit 10.

In the monochromatic mode, the secondary transfer roller 9, which is arranged inside of the loop of the recording sheet carriage belt 13, is moved away from the intermediate transfer belt 12 so as to separate the recording sheet carriage belt 13 from the intermediate transfer belt 12. A monochromatic image is then formed without driving the image forming units 1Y, 1M, and 1C for Y, M, and C and the intermediate transfer belt 12 so that the image forming units 1Y, 1M, and 1C for Y, M, and C and the intermediate transfer belt 12 are prevented from being worn out because of useless operations, resulting in extending the lifetime thereof.

Alternatively, the intermediate transfer belt 12 may be moved away from or brought into contact with the recording sheet carriage belt 13 by causing a unit not illustrated to displace the driving roller 8 supporting the intermediate transfer belt 12. In this case, because the orientation of the recording sheet P being conveyed does not change, the behavior of the recording sheet P between the recording sheet carriage belt 13 and the fixing unit 10 can be kept stable. Therefore, such a configuration can prevent wrinkles in the recording sheet P discharged from the fixing unit 10, which can suppress an image disturbance.

In the monochromatic mode, because the image forming unit 1B transfers the B toner image directly onto the recording sheet P fed into the direct transfer nip for B by the registration rollers 111, high speed printing can be achieved compared with a structure in which all of the image forming units 1Y, 1M, and 1C and the image forming unit 1B are arranged side by side along the stretched surface of the intermediate transfer belt 12; and the B toner image is transferred onto the recording sheet P in the secondary transfer nip via the intermediate transfer belt 12.

Figure 1:
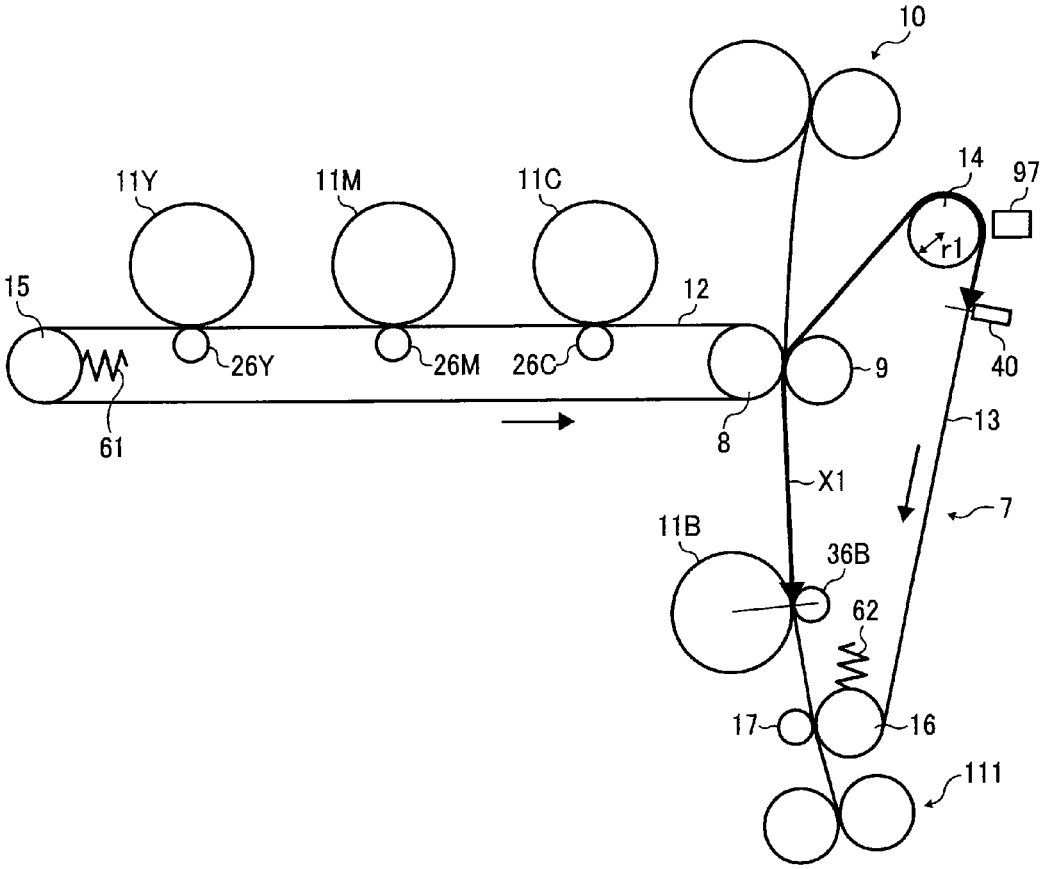
FIG. 1 is a schematic of a structure of a transfer section that is a characterizing portion of an image forming apparatus according to a first embodiment of the present invention.

FIG. 1 is a schematic of a structure of a transfer section that is a characterizing portion of the first embodiment.

As mentioned above, the intermediate transfer belt 12 is stretched across the driving roller 8, the tension roller 15, and so on; and the recording sheet carriage belt 13 is stretched across the secondary transfer roller 9, the driving roller 14, the tension roller 16, and so on. A driving motor, not illustrated, included in the printer main body drives the driving roller 14 in rotation, and the rotating recording sheet carriage belt 13, driven by the driving roller 14 in rotation, drives the secondary transfer roller 9 and the tension roller 16 in rotation. A paper attracting roller 17 is arranged at a position facing the tension roller 16 across the recording sheet carriage belt 13, and a power source not illustrated applies a predetermined voltage to the paper attracting roller 17 so that the recording sheet P is attracted to the recording sheet carriage belt 13 by means of an electrostatic force. The paper attracting roller 17 is kept in contact with the outer surface of the recording sheet carriage belt 13 (the outer surface of the loop), and is driven in rotation by the rotating recording sheet carriage belt 13.

In the image forming apparatus having the structure explained above, the positions of the photosensitive elements or optical elements in the writing units arranged inside of the image forming apparatus may change due to various factors such as impacts applied thereon during transportations or installations, vibrations caused by forming an image or conveying paper, or temperature changes in the image forming apparatus; and such positional changes could cause positional deviations in the images. Such positional deviations of the images can also be caused by decentering of rotating components, such as a photosensitive element or a transfer belt, or a fluctuation of the rotation speed thereof.

In a color image forming apparatus having a plurality of image forming units, relative positional deviations in the images of different colors may result in a color deviation, leading to unavoidable deteriorations of the image quality.

Figure 4:
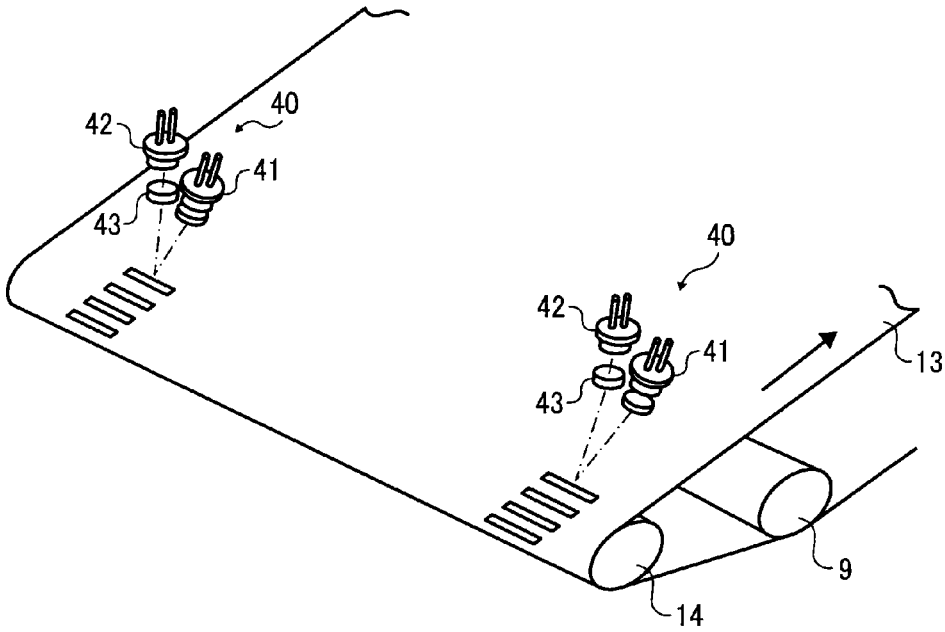
FIG. 4 is a schematic for explaining a pattern detecting unit that detects patterns on a recording sheet carriage belt.

Therefore, in the first embodiment, a color deviation detection control is performed at a predetermined operational timing. In the color deviation detection control to detect a color deviation, a pattern detecting sensor 40 that is a pattern image detecting unit illustrated in FIG. 4 is caused to detect pattern images for adjusting color alignment. The pattern detecting sensor 40 includes: an LED element 41 that is an illumination light source and a light-receiving element 42 for receiving reflected light arranged in pairs; and a pair of collecting lenses 43, all of which are arranged facing the outer surface of the recording sheet carriage belt 13 and respectively arranged on the lateral edges of an image area of the recording sheet carriage belt 13 along the belt width direction. The LED element 41 has an amount of light so that enough light is reflected to allow the light receiving element 42 to detect an adjustment pattern 44 formed on the recording sheet carriage belt 13. The light receiving element 42 is arranged at a position where the light reflected on the adjustment pattern 44 formed on the recording sheet carriage belt 13 is incident through the collecting lens 43, and includes a charged coupled device (CCD) configured as a liner light-receiving element in which many light-receiving pixels are arranged linearly.

Examples of the predetermined operational timing include an operational timing at which an operation changing the pattern of the speed fluctuation is performed, e.g., the process unit is replaced; an operational timing at which a print command is issued while a high-quality printing mode is selected; an operational timing at which a predetermined number of sheets, e.g., 200 sheets, has been counted to be fed for color printing; an operational timing at which a predetermined temperature change, e.g., a change of five degrees, is detected by a temperature sensor; or an operational timing at which a predetermined length of time, e.g., six hours, have been measured to elapse by a timer since the last adjustment is performed.

In the color deviation detection control, driving motors not illustrated, each for rotating each of the photosensitive elements 11Y, 11C, 11M, and 11B, are rotated at constant speed; and the pattern image is formed on each of the photosensitive elements 11Y, 11C, 11M, and 11B. The Y, C, M, and B pattern images formed on the respective photosensitive elements 11Y, 11C, 11M, and 11B are eventually transferred onto the recording sheet carriage belt 13 without overlapping with each other.

Figure 3:
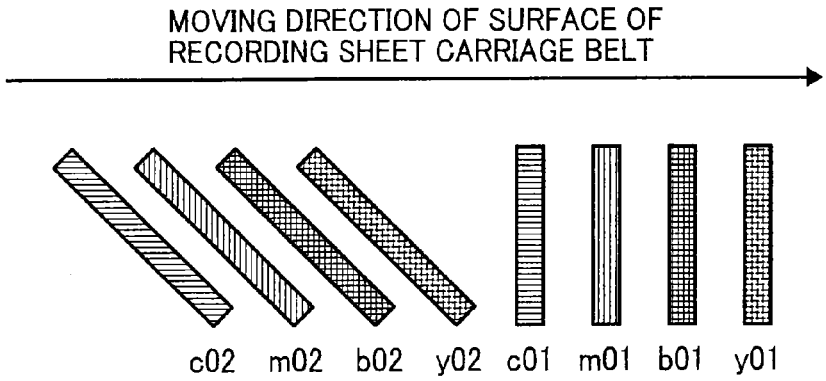
FIG. 3 is a schematic of an example of pattern images for adjusting color alignment.

The pattern images for adjusting color alignment are transferred onto the recording sheet carriage belt 13 so that the pattern images of respective colors are arranged at a predetermined pitch along the rotating direction of the intermediate transfer belt (sub-scanning direction), such as b01, c01, m01, y01, b02, c02, m02, and y02 illustrated in FIG. 3. Because horizontal pattern images 01 arranged in a direction perpendicular to the rotating direction of the recording medium carriage belt and diagonal pattern images 02 arranged in a direction intersecting with the rotating direction of the recording medium carriage belt at 45 degrees are used as the pattern images; color deviations both in the rotating direction of the recording medium carriage belt (sub-scanning direction) and the direction perpendicular to the rotating direction of the recording medium carriage belt (main-scanning direction) can be detected.

Moreover, because the pattern image is formed in plurality along the rotating direction of the recording medium carriage belt (sub-scanning direction), a sub-scanning scaling deviation along the rotating direction of the recording medium carriage belt (sub-scanning direction) can be detected for each of the colors. Furthermore, because the pattern image is formed in plurality along the direction perpendicular to the rotating direction of the recording medium carriage belt (main-scanning direction), a main-scanning scaling deviation, a bent, or a skew deviation along the direction perpendicular to the rotating direction of the recording medium carriage belt (main-scanning direction) can also be detected for each of the colors. Furthermore, in order to improve the precision of the color alignment adjustment, the pattern image detection may be repeated for a plurality of number of times to obtain an average of the detection results.

The speed fluctuations in the rotation cycle of the driving roller 14 due to factors such as decentering or fluctuating load of the driving roller 14 rotatably stretching the recording sheet carriage belt 13 cause the rotation speed of the recording sheet carriage belt to fluctuate in the rotation cycle of the driving roller 14.

In the first embodiment, to detect a fluctuation of the pattern interval corresponding to the speed fluctuation of the recording sheet carriage belt 13 in the rotation cycle of the driving roller 14, the pattern detecting sensor 40 detects a detection pattern (shown as c02 to y01 in FIG. 3) formed on the recording sheet carriage belt 13 in an image forming unit 1. The image forming unit 1 forming the detection pattern, the recording sheet carriage belt 13 on which the detection pattern is formed, and the pattern detecting sensor 40 that detects the detection pattern formed on the recording sheet carriage belt 13 function as a speed fluctuation detecting unit that detects a cyclic speed fluctuation of the recording sheet carriage belt 13.

Figure 5:
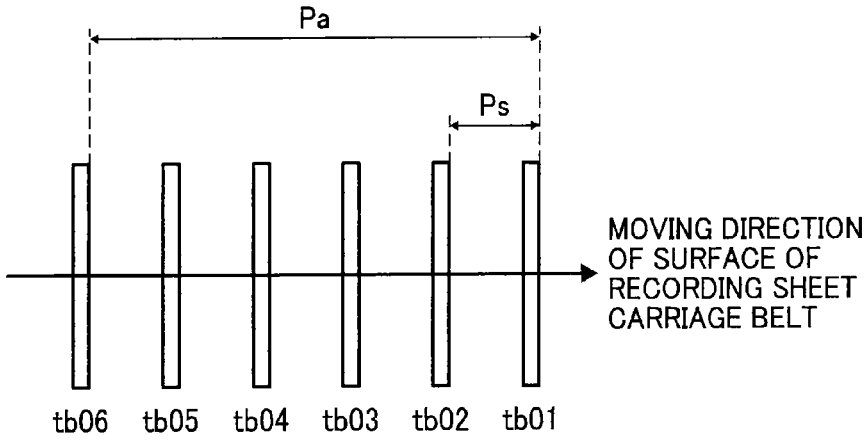
FIG. 5 is a schematic of an example of pattern images used for detecting a fluctuation component.

As the detection pattern used for detecting such a fluctuation component, a group of patterns consisting of black toner images, which are formed in one of the colors black, magenta, cyan, and yellow, is formed along the direction perpendicular to the conveying direction of the recording sheet carriage belt 13 at a predetermined pitch Ps, as illustrated in FIG. 5 for example; and the time of detection of each of the patterns measured from a given reference operational timing is read, as the recording sheet carriage belt 13 is moved.

In this example, the pattern detecting sensor 40 recognizes the detection time with reference to the given reference operational timing as tb01, tb02, tb03, tb04, tb05, and tb06, respectively, in the order of the formed patterns. In this manner, based on detection data of the detection time obtained by the pattern detecting sensor 40 detecting the detection pattern, can be obtained the amplitude and the phase of the waveform of a component of the pattern interval fluctuation corresponding to the speed fluctuation of the recording sheet carriage belt 13 in the rotation cycle of the driving roller 14. Furthermore, by forming the single-colored patterns more densely, the pattern interval fluctuation component can be detected more precisely.

By making the pitch Ps between the patterns included in the pattern group be a value obtained by dividing the circumferential length of the driving roller 14 by an integral number, simplified can be data processing performed in controlling a positional deviation caused by the speed fluctuation in the rotation cycle of the driving roller 14. In addition, by making the length Pa of the detection pattern along the moving direction of the surface of the recording sheet carriage belt 13 illustrated in FIG. 5 be an integral multiple of the circumferential length of the driving roller 14, the pattern interval fluctuation corresponding to the speed fluctuation of the recording sheet carriage belt 13 in the rotation cycle of the driving roller 14 can be detected appropriately.

The printer according to the first embodiment is configured to satisfy Equation 1 below, where r1 is the radius of the driving roller 14 driving the recording sheet carriage belt 13 in rotation; and X1 is the distance between the direct transfer nip for B and a pattern detecting unit. In Equation 1, n1 is a positive integer, and the coefficient $\alpha$ is $(1/12)\pi \leq \alpha \leq (23/12)\pi$. The distance between the nips is distance between the centers of the nips.

$$X1=\alpha \cdot r1 \cdot n1 \quad (1)$$

Because the recording sheet P, which is fed into the nip formed between the tension roller 16 and the paper attracting roller 17 set on the recording sheet carriage belt 13, is conveyed and carried in a manner being attracted to the recording sheet carriage belt 13, the conveying speed of the recording sheet P is influenced by the speed fluctuation of the rotation speed of the recording sheet carriage belt 13. Therefore, the speed fluctuations, which are in the rotation cycle of the driving roller 14 driving the recording sheet carriage belt 13 in rotation, occur in the conveying speed of the recording sheet P after being fed into the nip formed between the tension roller 16 and the paper attracting roller 17 via the recording sheet carriage belt 13 and further carried on the recording sheet carriage belt 13.

In the first embodiment, as indicated in Equation 1, the distance between the direct transfer nip for B and the pattern detecting unit is set so as not to be a positive integral multiple of the circumferential length (one rotation pitch) of the driving roller 14. In this manner, the phases of the speed fluctuations occurring on the recording sheet carriage belt 13 in the rotation cycle of the driving roller 14 would be different at the direct transfer nip and the pattern detecting position of the pattern detecting sensor 40 detecting the detection pattern images. In this manner, by allowing the pattern detecting unit to detect the detection pattern images transferred from the photosensitive element 11B onto the recording sheet carriage belt 13 in the direct transfer nip, the pattern interval fluctuation component corresponding to the speed fluctuation of the recording sheet carriage belt 13 in the rotation cycle of the driving roller 14 can be detected. A control unit, not illustrated, included in the image forming apparatus then extracts a component of the pattern interval fluctuation corresponding to the speed fluctuation of the recording sheet carriage belt 13 in the rotation cycle of the driving roller 14 from the detection result.

If the coefficient $\alpha$ is outside of the range indicated in Equation 1, the distance X1 between the direct transfer nip for B and the pattern detecting position of the pattern detecting sensor 40 is set to be near to a positive integral multiple of the circumferential length of the driving roller 14, and it might be difficult to detect the pattern interval fluctuation component corresponding to the speed fluctuation of the recording sheet carriage belt 13 due to the rotation cycle of the driving roller 14. Therefore, by keeping the coefficient $\alpha$ within the range indicated in Equation 1, the pattern detecting unit can easily detect the pattern interval fluctuation component corresponding to the speed fluctuation of the recording sheet carriage belt 13 in the rotation cycle of the driving roller 14.

Figure 6:
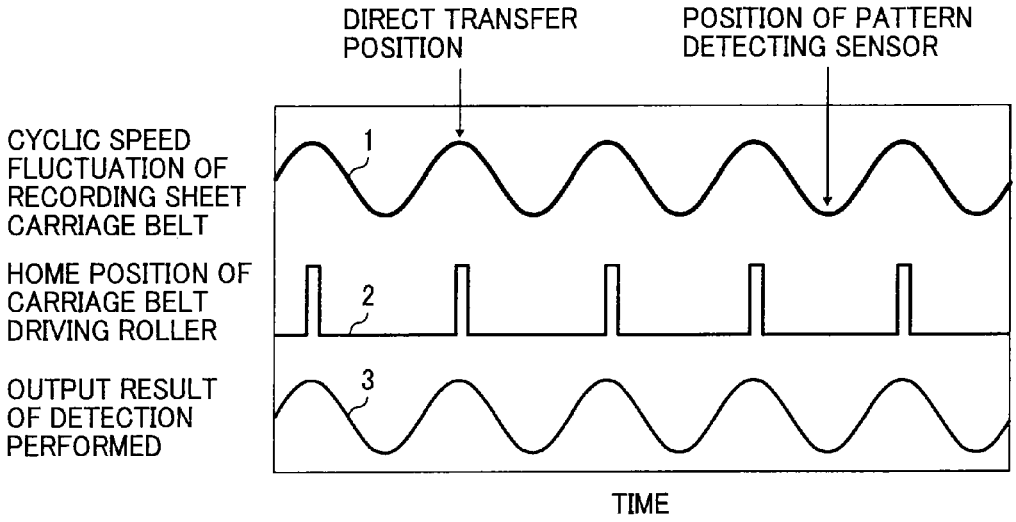
FIG. 6 is a waveform diagram when a pattern detecting sensor is arranged at a position where a distance X1 is not a positive integral multiple of the circumferential length of a driving roller.

In the example illustrated in FIG. 6, the pattern detecting sensor 40 is arranged where the distance X1 is not a positive integral multiple of the circumferential length of the driving roller 14. The waveform 1 in FIG. 6 represents a waveform of the speed fluctuation of the recording sheet carriage belt 13 in the rotation cycle of the driving roller 14. Furthermore, a home position detecting sensor 97 is arranged to detect a home position that is a reference position of the driving roller 14. The waveform 2 represents the waveform of a sensor output of the home position detecting sensor 97. The waveform 3 represents the waveform of the pattern interval fluctuation component output from the pattern detecting sensor 40 and corresponding to the speed fluctuation of the recording sheet carriage belt 13 in the rotation cycle of the driving roller 14. As illustrated in FIG. 6, by sampling the sensor output of the home position detecting sensor 97 at the same time as extraction of the pattern interval fluctuation component output from the pattern detecting sensor 40 and corresponding to the speed fluctuation of the recording sheet carriage belt 13 in the rotation cycle of the driving roller 14, the waveform of the sensor output of the home position detecting sensor 97 can be associated with the waveform of the pattern interval fluctuation component corresponding to the speed fluctuation of the recording sheet carriage belt 13 in the rotation cycle of the driving roller 14.

In this manner, the operational timing of detection of the home position of the driving roller 14 obtained from the sensor output of the home position detecting sensor 97 is associated with the waveform of the pattern interval fluctuation component corresponding to the speed fluctuation of the recording sheet carriage belt 13 in the rotation cycle of the driving roller 14 obtained from the detection result of the pattern detecting sensor 40. Based on the amplitude and the phase of the waveform of the pattern interval fluctuation component corresponding to the speed fluctuation of the recording sheet carriage belt 13 in the rotation cycle of the driving roller 14, the control unit, not illustrated, included in the image forming apparatus performs rotation drive control on the driving roller 14 so as to cancel out the speed fluctuation of the recording sheet carriage belt 13 in the rotation cycle of the driving roller 14. In other words, the control unit changes the rotation speed of the driving roller 14 so that a correction is applied in a manner to bring closer to zero of the amplitude of the waveform of the pattern interval fluctuation component corresponding to the speed fluctuation of the recording sheet carriage belt 13 in the rotation cycle of the driving roller 14. In this manner, the speed fluctuation of the recording sheet carriage belt 13 in the rotation cycle of the driving roller 14 can be suppressed; and suppressed can be a positional deviation caused by the speed fluctuation of the recording sheet carriage belt 13 in the rotation cycle of the driving roller 14.

Figure 7:
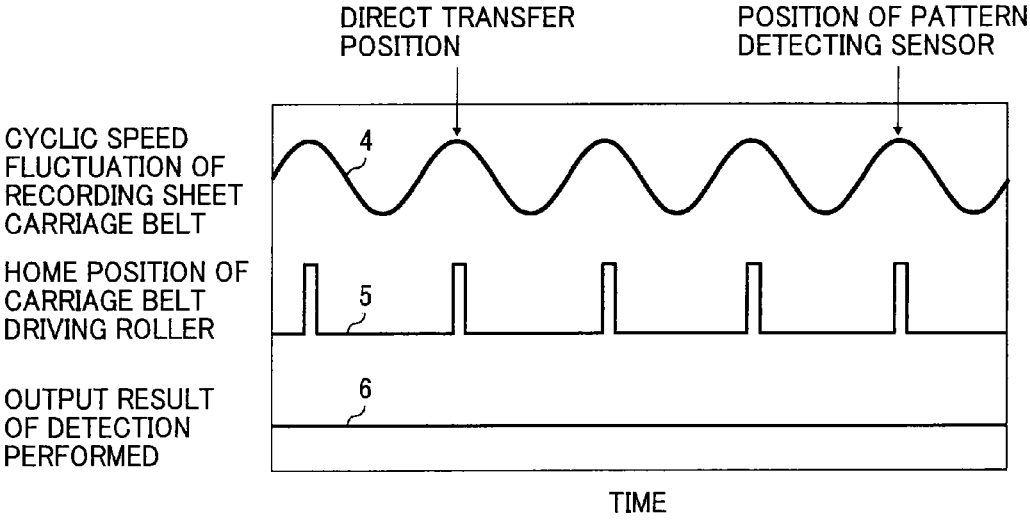
FIG. 7 is a waveform diagram when the pattern detecting sensor is arranged at a position where the distance X1 is a positive integral multiple of the circumferential length of the driving roller.

On the contrary, if the pattern detecting sensor 40 is arranged at a position where the distance X1 is a positive integral multiple of the circumferential length of the driving roller 14, the speed fluctuations of the rotation cycle of the driving roller 14 occurring on the recording sheet carriage belt 13 would be at the same phase both at the direct transfer nip and the pattern detecting position of the pattern detecting sensor 40 detecting the detection pattern images, as indicated in the waveform 4 in FIG. 7, even if the recording sheet carriage belt 13 has the speed fluctuation in the rotation cycle of the driving roller 14. Thus, the pattern detecting sensor 40 would be unable to detect the pattern interval fluctuation component corresponding to the speed fluctuation of the recording sheet carriage belt 13 in the rotation cycle of the driving roller 14, as indicated in the wave 6. Therefore, even if the rotation drive control is performed on the driving roller 14 using the detection result of the pattern detecting sensor 40 so as to cancel out the speed fluctuation of the recording sheet carriage belt 13 in the rotation cycle of the driving roller 14, the speed fluctuation of the recording sheet carriage belt 13 in the rotation cycle of the driving roller 14 cannot be suppressed.

If the photosensitive element 11B also has a speed fluctuation in the rotation cycle due to factors such as decentering or fluctuating load of the photosensitive element 11B, the speed fluctuations of the rotation cycle of the photosensitive element 11B cause a positional deviation in the image transferred from the photosensitive element 11B onto the recording sheet P. Therefore, the speed fluctuation in the rotation cycle of the photosensitive element 11B would be added to the detection pattern transferred from the photosensitive element 11B onto the recording sheet carriage belt 13, as well as the speed fluctuation in the rotation cycle of the driving roller 14.

By making the pitch Ps between the patterns included in the pattern group be a submultiple of the circumferential length of the driving roller 14 as well as a submultiple of the circumferential length of a photosensitive element 11, data processing performed in controlling the positional deviation caused by the speed fluctuation of the recording sheet carriage belt 13 in the rotation cycle of the driving roller 14 and controlling the positional deviation caused by the speed fluctuation in the rotation cycle of the photosensitive element 11, which will be described later, can be made easier. Moreover, by making the length Pa of the detection pattern along the moving direction of the surface of the recording sheet carriage belt 13 be an integral multiple of the circumferential length of the driving roller 14 as well as an integral multiple of the circumferential length of the photosensitive element 11B, can be detected appropriately the pattern interval speed fluctuation corresponding to the speed fluctuation of the recording sheet carriage belt 13 in the rotation cycle of the driving roller 14 and the pattern interval fluctuation corresponding to the speed fluctuation in the rotation cycle of the photosensitive element 11.

Based on the detection result of the pattern detecting sensor 40 detecting the detection pattern (shown as c02 to y01 in FIG. 3), the control unit, not illustrated but included in the image forming apparatus, extracts a component of the speed fluctuation in the rotation cycle of the driving roller 14 and a component of the speed fluctuation in the rotation cycle of the photosensitive element 11B separately, by using a known quadrature detection process, for example. Based on the speed fluctuation component in the rotation cycle of the photosensitive element 11B, the control unit, not illustrated but included in the image forming apparatus, then controls driving of the driving motor driving the photosensitive element 11B in rotation so as to cancel out the speed fluctuation in the rotation cycle of the photosensitive element 11B. In this manner, the speed fluctuation in the rotation cycle of the photosensitive element 11B can be suppressed, which prevents a positional deviation caused by the speed fluctuations in the rotation cycle of the photosensitive element 11B from occurring in the image transferred from the photosensitive element 11B onto the recording sheet P.

At the same time, based on the speed fluctuation component in the rotation cycle of the driving roller 14, the control unit, not illustrated but included in the image forming apparatus, performs rotation drive control on the driving roller 14 so that the speed fluctuation of the recording sheet carriage belt 13 in the rotation cycle of the driving roller 14 is cancelled out in the manner described above. In this manner, the speed fluctuation of the recording sheet carriage belt 13 in the rotation cycle of the driving roller 14 can be suppressed to reduce the positional deviation caused by the speed fluctuation of the recording sheet carriage belt 13 in the rotation cycle of the driving roller 14.

Second Embodiment

Figure 8:
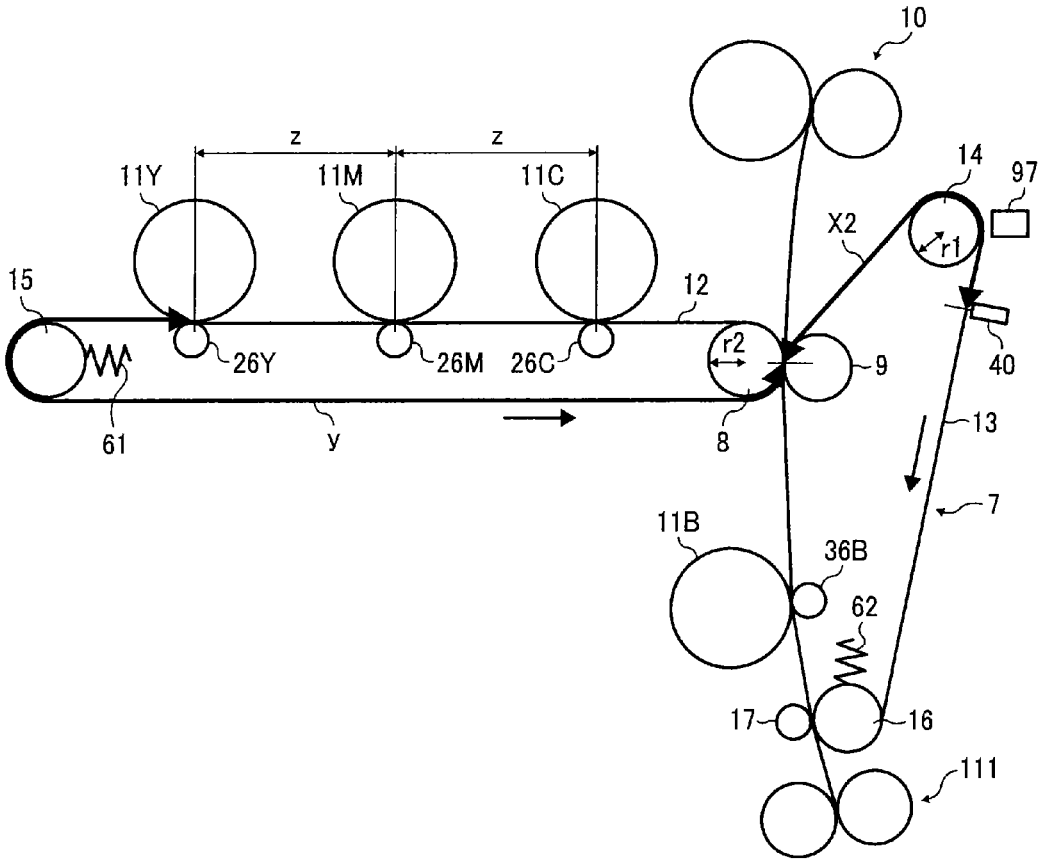
FIG. 8 is a schematic of a structure of a transfer section that is a characterizing portion of an image forming apparatus according to a second embodiment of the present invention.

A second embodiment of the present invention applied to a color laser printer (hereinafter, simply referred to as a "printer") that is an electrophotographic image forming apparatus is described below. FIG. 8 is a schematic of a structure of a transfer section that is a characterizing portion of the second embodiment.

In the second embodiment, as the detection pattern used for detecting the fluctuation component, yellow toner images, which are the images of one of the colors of cyan, magenta, and yellow, are transferred from the photosensitive element 11Y onto the recording sheet carriage belt 13 via the intermediate transfer belt 12 to form a pattern group in which the images are arranged in the direction perpendicular to the conveying direction of the recording sheet carriage belt 13 at a predetermined pitch Ps; and the time of detection of each of the patterns measured from a given reference operational timing is read, as the recording sheet carriage belt 13 is moved. In this manner, based on detection data of the detection time obtained by the pattern detecting sensor 40 detecting the detection pattern, the amplitude and the phase of a waveform of the pattern interval fluctuation component corresponding to the speed fluctuation of the recording sheet carriage belt 13 in the rotation cycle of the driving roller 14 can be obtained.

In the example where the pattern group is transferred from the photosensitive element 11Y onto the recording sheet carriage belt 13 via the intermediate transfer belt 12, by making the pitch Ps between the patterns included in the pattern group be a value obtained by dividing the circumferential length of the driving roller 14 by an integral number, data processing performed in controlling a positional deviation caused by the speed fluctuation in the rotation cycle of the driving roller 14 can be easily done. In addition, by making the length Pa of the detection pattern in the moving direction of the surface of the recording sheet carriage belt 13 an integral multiple of the circumferential length of the driving roller 14, the pattern interval fluctuation corresponding to the speed fluctuation of the recording sheet carriage belt 13 in the rotation cycle of the driving roller 14 can be detected appropriately.

When the pattern group mentioned above is transferred from the photosensitive element 11Y onto the recording sheet carriage belt 13 via the intermediate transfer belt 12 in order to detect the pattern interval fluctuation component corresponding to the speed fluctuation of the recording sheet carriage belt 13 in the rotation cycle of the driving roller 14, the printer should be configured to satisfy Equation 2 below, where r1 is the radius of the driving roller 14 driving the recording sheet carriage belt 13 in rotation, and X2 is the distance between the secondary transfer nip and the pattern detecting unit. In Equation 2, n2 is a positive integer, and the coefficient β is $(1/12)\pi \leq \beta \leq (23/12)\pi$. The distance between the nips are the distance between the centers of the nips.

$$X2=\beta \cdot r1 \cdot n2 \quad (2)$$

Because the recording sheet P, fed into the nip formed between the tension roller 16 and the paper attracting roller 17 via the recording sheet carriage belt 13, is conveyed by being carried in a manner attracted to the recording sheet carriage belt 13, the conveying speed of the recording sheet P is influenced by the speed fluctuation of the rotation speed of the recording sheet carriage belt 13. Therefore, the speed fluctuations in the rotation cycle of the driving roller 14 driving the recording sheet carriage belt 13 in rotation occur on the conveying speed of the recording sheet P after being fed into the nip formed between the tension roller 16 and the paper attracting roller 17 via the recording sheet carriage belt 13 and further carried on the recording sheet carriage belt 13.

In the second embodiment, as indicated in Equation 2, the distance between the secondary transfer nip and the pattern detecting position of the pattern detecting sensor 40 is set so as not to be a positive integral multiple of the circumferential length (one rotation pitch) of the driving roller 14. In this manner, by allowing the pattern detecting sensor 40 to detect the detection pattern images transferred from the intermediate transfer belt 12 onto the recording sheet carriage belt 13 in the secondary transfer nip, the pattern interval fluctuation component corresponding to the speed fluctuation of the recording sheet carriage belt 13 in the rotation cycle of the driving roller 14 can be detected. The control unit, not illustrated but included in the image forming apparatus, then extracts a component of the pattern interval fluctuation corresponding to the speed fluctuation of the recording sheet carriage belt 13 in the rotation cycle of the driving roller 14 from the detection result.

If the coefficient β is outside of the range indicated by Equation 2, the distance X2 between the secondary transfer nip and the pattern detecting position of the pattern detecting sensor 40 becomes near to a positive integral multiple of the circumferential length of the driving roller 14; and it might become difficult to detect the pattern interval fluctuation component corresponding to the speed fluctuation of the recording sheet carriage belt 13 in the rotation cycle of the driving roller 14. Therefore, by keeping the coefficient β within the range indicated by Equation 2, the pattern detecting sensor 40 can easily detect the pattern interval fluctuation component corresponding to the speed fluctuation of the recording sheet carriage belt 13 in the rotation cycle of the driving roller 14.

Furthermore, by sampling the sensor output of the home position detecting sensor 97 at the same time as extraction of the pattern interval fluctuation component corresponding to the speed fluctuation of the recording sheet carriage belt 13 in the rotation cycle of the driving roller 14, the waveform of the sensor output of the home position detecting sensor 97 can be associated with the waveform of the pattern interval fluctuation component corresponding to the speed fluctuation of the recording sheet carriage belt 13 in the rotation cycle of the driving roller 14.

In this manner, the operational timing of detection of the home position of the driving roller 14, obtained from the sensor output of the home position detecting sensor 97, is associated with the waveform of the pattern interval fluctuation component corresponding to the speed fluctuation of the recording sheet carriage belt 13 in the rotation cycle of the driving roller 14 obtained from the detection result of the pattern detecting sensor 40. Based on the amplitude and the phase of the waveform of the pattern interval fluctuation component corresponding to the speed fluctuation of the recording sheet carriage belt 13 in the rotation cycle of the driving roller 14, the control unit, not illustrated but included in the image forming apparatus, performs rotation drive control on the driving roller 14 so as to cancel out the speed fluctuation of the recording sheet carriage belt 13 in the rotation cycle of the driving roller 14. In other words, the control unit changes the rotation speed of the driving roller 14 so that a correction is applied in a manner to bring the amplitude of the waveform of the pattern interval fluctuation component corresponding to the speed fluctuation of the recording sheet carriage belt 13 in the rotation cycle of the driving roller 14 closer to zero. In this manner, the speed fluctuation of the recording sheet carriage belt 13 in the rotation cycle of the driving roller 14 can be suppressed; and a positional deviation caused by the speed fluctuation of the recording sheet carriage belt 13 in the rotation cycle of the driving roller 14 can be suppressed.

On the contrary, if the pattern detecting sensor 40 is arranged at a position where the distance X1 is a positive integral multiple of the circumferential length of the driving roller 14, the speed fluctuations in the rotation cycle of the driving roller 14 occurring on the recording sheet carriage belt 13 would be at the same phase at the secondary transfer nip and the pattern detecting position of the pattern detecting sensor 40 detecting the detection pattern images, even if the recording sheet carriage belt 13 has the speed fluctuation in the rotation cycle of the driving roller 14. Thus, the pattern detecting sensor 40 would be unable to detect the pattern interval fluctuation component corresponding to the speed fluctuation of the recording sheet carriage belt 13 in the rotation cycle of the driving roller 14. Therefore, even if the rotation drive control is performed on the driving roller 14 using the detection result of the pattern detecting sensor 40 so as to cancel out the speed fluctuation of the recording sheet carriage belt 13 in the rotation cycle of the driving roller 14, the speed fluctuation of the recording sheet carriage belt 13 in the rotation cycle of the driving roller 14 cannot be suppressed.

If the photosensitive element 11Y also has a speed fluctuation in the rotation cycle due to factors such as decentering or fluctuating load of the photosensitive element 11Y, the speed fluctuations in rotation cycle of the photosensitive element 11Y cause a positional deviation in the image transferred from the photosensitive element 11Y onto the recording sheet P via the intermediate transfer belt 12. Therefore, the speed fluctuation in the rotation cycle of the photosensitive element 11Y would be added to the detection pattern transferred from the photosensitive element 11Y onto the recording sheet carriage belt 13 via the intermediate transfer belt 12, as well as the speed fluctuation in the rotation cycle of the driving roller 14.

By making the pitch Ps between the patterns included in the pattern group be a value obtained by dividing the circumferential length of the driving roller 14 by an integral number, as well as a value obtained by dividing the circumferential length of the photosensitive element 11Y, data processing performed in controlling the positional deviation caused by the speed fluctuation of the recording sheet carriage belt 13 in the rotation cycle of the driving roller 14 and controlling the positional deviation caused by the speed fluctuation in the rotation cycle of the photosensitive element 11Y, which will be described later, can be done easily. Moreover, by making the length Pa of the detection pattern along the moving direction of the surface of the recording sheet carriage belt 13 be an integral multiple of the circumferential length of the driving roller 14 as well as an integral multiple of the circumferential length of the photosensitive element 11Y, the pattern interval speed fluctuation corresponding to the speed fluctuation of the recording sheet carriage belt 13 in the rotation cycle of the driving roller 14 and the pattern interval fluctuation corresponding to the speed fluctuation in the rotation cycle of the photosensitive element 11Y can be detected appropriately.

Based on the detection result of the pattern detecting sensor 40 detecting the detection pattern, the control unit, not illustrated but included in the image forming apparatus, extracts a component of the speed fluctuation in the rotation cycle of the driving roller 14; and a component of the speed fluctuation in the rotation cycle of the photosensitive element 11Y separately, using a known quadrature detection process, for example. Based on the component of the speed fluctuation in the rotation cycle of the photosensitive element 11Y, the control unit, not illustrated but included in the image forming apparatus, then controls driving of the driving motor driving the photosensitive element 11Y in rotation so as to cancel out the speed fluctuation in the rotation cycle of the photosensitive element 11Y. In this manner, the speed fluctuation in the rotation cycle of the photosensitive element 11Y can be suppressed, which prevents a positional deviation caused by the speed fluctuation in the rotation cycle of the photosensitive element 11Y from occurring in the image transferred from the photosensitive element 11Y onto the recording sheet P via the intermediate transfer belt 12.

At the same time, based on the speed fluctuation component in the rotation cycle of the driving roller 14, the control unit, not illustrated but included in the image forming apparatus, performs rotation drive control on the driving roller 14 so that the speed fluctuation of the recording sheet carriage belt 13 in the rotation cycle of the driving roller 14 is cancelled out in the manner described above. In this manner, the speed fluctuation of the recording sheet carriage belt 13 in the rotation cycle of the driving roller 14 can be suppressed to reduce the positional deviation caused by the speed fluctuation of the recording sheet carriage belt 13 in the rotation cycle of the driving roller 14.

The conveying speed of the intermediate transfer belt 12 has a speed fluctuation in the rotation cycle of the driving roller 8 because of factors such as decentering of the driving roller 8 driving the intermediate transfer belt 12 in rotation. Therefore, a positional deviation occurs in the rotation cycle of the driving roller 8 in Y, M, and C toner images primarily transferred from the photosensitive elements 11Y, 11M, and 11C onto the intermediate transfer belt 12.

The printer according to the embodiment is configured to satisfy relations expressed by Equation 3 and Equation 4 below, where r2 is the radius of the driving roller 8 driving the intermediate transfer belt 12 in rotation, y is the distance between the primary transfer nip for Y and the secondary transfer nip along the path of the intermediate transfer belt 12 toward downstream in the rotating direction of the intermediate transfer belt; and z is the shortest distance between the primary transfer nip for C and the primary transfer nip for M, or the shortest distance between the primary transfer nip for M and the primary transfer nip for Y, that is, a station pitch between the two adjacent image forming units 1Y, 1M, and 1C. n3 in Equation 3 and n4 in Equation 4 is a positive integer. The distance between the nips are the distance between the centers of the nips.

$$y=2\pi r2\cdot n3 \tag{3}$$

$$z=2\pi r2\cdot n4 \tag{4}$$

As expressed in Equation 4, because the station pitch z and the circumferential length (one rotation pitch) of the driving roller 8 are set to be the same length, the images arrive at the primary transfer nips for Y, M, and C always at the same phase. In this manner, a color deviation in the Y, M, and C toner images primarily transferred onto the intermediate transfer belt 12 can be suppressed.

The intermediate transfer belt 12, which is sequentially transferred with the C, M, and Y toner images in the primary transfer nips for C, M, and Y, is driven to rotate with a speed fluctuation in the rotation cycle of the driving roller 8 so as to convey the three-color superimposed image from the primary transfer nip for Y to the secondary transfer nip.

At this time, if the speed of the intermediate transfer belt 12 at the primary transfer nip for Y and the speed thereof at the secondary transfer nip are different, although no color deviation occurs in the three-color superimposed image transferred from the intermediate transfer belt 12 onto the recording sheet P in the secondary transfer nip, the image will be formed elongated or shrunk on the recording sheet P.

Therefore, as expressed in Equation 3, because the distance y between the primary transfer nip for Y and the secondary transfer nip is a positive integral multiple of the circumferential length (one rotation pitch) of the driving roller 8, the speed of the intermediate transfer belt 12 has a speed fluctuation at the same phase at the primary transfer nip for Y and the secondary transfer nip. Therefore, elongation or shrinkage of the image can be suppressed.

According to each of the embodiments, the image forming apparatus includes: the photosensitive element 11Y that is a first image carrier; the image forming unit 10 that is a first image forming unit that forms an image on the photosensitive element 11Y; the intermediate transfer belt 12 on which the image formed on the photosensitive element 11Y is primarily transferred; the primary transfer roller 26C that is a primary transfer unit that primarily transfers the image from the photosensitive element 11Y onto the intermediate transfer belt 12; the secondary transfer roller 9 that is a secondary transfer unit that secondarily transfers the image transferred onto the intermediate transfer belt 12 onto the recording sheet P that is a recording medium; the photosensitive element 11B that is a second image carrier arranged upstream or downstream of the secondary transfer position at which the image is secondarily transferred from the intermediate transfer belt 12 onto the recording sheet P in the recording sheet conveying direction; the image forming unit 1B that is a second image forming unit that forms an image on the photosensitive element 11B; the transfer roller 36B that is a direct transfer unit that directly transfers the image formed on the photosensitive element 11B onto the recording sheet; the recording sheet carriage belt 13 that is a recording medium carriage belt that carries and conveys the recording sheet P so as to pass through the direct transfer position at which the image is directly transferred from the photosensitive element 11B onto the recording sheet P and the secondary transfer position, and is rotatably stretched across a plurality of roller members; the driving roller 14 that is one of the roller members that stretch the recording sheet carriage belt 13 and drives the recording sheet carriage belt 13 in rotation; the speed fluctuation detecting unit that detects a cyclic speed fluctuation of the recording sheet carriage belt 13; and the control unit that is a drive control unit included in the image forming apparatus and controls driving of the driving roller 14 so as to reduce the cyclic speed fluctuation of the recording sheet carriage belt 13 based on the detection result of the speed fluctuation detecting unit. By allowing the control unit to control driving of the driving roller 14 so as to reduce the cyclic speed fluctuation of the recording sheet carriage belt 13 detected by the speed fluctuation detecting unit, the cyclic speed fluctuation can be suppressed in the recording sheet carriage belt 13. Therefore, a positional deviation caused by the cyclic speed fluctuation of the recording sheet carriage belt can be suppressed in the images which are transferred onto the recording sheet P in the direct transfer nip and the secondary transfer nip regardless of the positional relation between the direct transfer nip and the secondary transfer nip. Furthermore, the limitation in the positional relation between the direct transfer nip and the secondary transfer nip found in the image forming apparatus disclosed in the previous application can be eliminated. Therefore, the interval between the direct transfer nip and the secondary transfer nip can be reduced so as to reduce the size of the image forming apparatus.

Furthermore, according to the embodiments, the speed fluctuation detecting unit includes: the pattern detecting sensor 40 that is a pattern image detecting unit that detects a plurality of pattern images formed on the photosensitive element 11B and then transferred onto the recording sheet carriage belt 13, and is arranged facing the outer surface of the recording sheet carriage belt 13. Moreover, the control unit obtains the speed fluctuation of the recording sheet carriage belt 13 in the rotation cycle of the driving roller driving the recording sheet carriage belt 13 based on the detection data detected by the pattern detecting sensor 40, and controls driving of the driving roller 14 in the manner to reduce the speed fluctuation. In addition, the interval along the rotating direction of the recording sheet carriage belt between the direct transfer nip and the detecting position of the pattern detecting sensor 40 detecting the pattern images is set so as not to be a positive integral multiple of the circumferential length of the driving roller 14. In this manner, the speed fluctuation of the recording sheet carriage belt 13 in the rotation cycle of the driving roller 14 would be at a different phase at each of the direct transfer nip and the pattern detecting position for the pattern detecting sensor 40 to detect the pattern images, so that the component of the speed fluctuation of the recording sheet carriage belt 13 in the rotation cycle of the driving roller 14 can be detected by allowing the pattern detecting sensor 40 to detect the pattern images formed on the recording sheet carriage belt 13. Based on the detection result, the control unit obtains the amplitude and the phase of the pattern interval fluctuation component corresponding to the speed fluctuation of the recording sheet carriage belt 13 in the rotation cycle of the driving roller 14, and performs rotation drive control on the driving roller 14 so as to reduce the speed fluctuation of the recording sheet carriage belt 13 in the rotation cycle of the driving roller 14. In this manner, the speed fluctuation of the recording sheet carriage belt 13 in the rotation cycle of the driving roller 14 can be suppressed.

Furthermore, according to the embodiments, the speed fluctuation detecting unit includes the pattern detecting sensor 40 that is a pattern image detecting unit that detects the pattern images formed on the photosensitive element 11Y and then transferred onto the recording sheet carriage belt 13 via the intermediate transfer belt 12, and is arranged facing the outer surface of the recording sheet carriage belt 13. The control unit obtains the speed fluctuation of the recording sheet carriage belt 13 in the rotation cycle of the driving roller based on the detection data detected by the pattern detecting sensor 40, and controls driving of the driving roller 14 so as to reduce the speed fluctuation of the recording sheet carriage belt 13. The interval in the rotating direction of the recording sheet carriage belt between the secondary transfer nip and the detecting position of the pattern detecting sensor 40 detecting the pattern images is set so as not to be a positive integral multiple of the circumferential length of the driving roller 14. In this manner, the speed fluctuation of the recording sheet carriage belt 13 in the rotation cycle of the driving roller 14 would be at a different phase at each of the secondary transfer nip and the pattern detecting position of the pattern detecting sensor 40 detecting the pattern images, so that the component of the speed fluctuation of the recording sheet carriage belt 13 in the rotation cycle of the driving roller 14 can be detected by allowing the pattern detecting sensor 40 to detect the pattern images formed on the recording sheet carriage belt 13. Based on the detection result, the control unit obtains the amplitude and the phase of the pattern interval fluctuation component corresponding to the speed fluctuation of the recording sheet carriage belt 13 in the rotation cycle of the driving roller 14, and performs rotation drive control on the driving roller 14 so as to reduce the speed fluctuation of the recording sheet carriage belt 13 in the rotation cycle of the driving roller 14. In this manner, the speed fluctuation of the recording sheet carriage belt 13 in the rotation cycle of the driving roller 14 can be suppressed.

Furthermore, according to the embodiment, the image forming apparatus includes: the control unit that also functions as a second image carrier drive control unit that obtains the cyclic speed fluctuation of the photosensitive element 11B from the detection data detected by the pattern detecting sensor 40, and controls driving of the photosensitive element 11B so as to reduce the speed fluctuation thereof. In this manner, the cyclic speed fluctuation of the photosensitive element 11B can be suppressed, and a positional deviation caused by the cyclic speed fluctuation of the photosensitive element 11B can be suppressed in the image transferred from the photosensitive element 11B onto the recording sheet P.

Furthermore, according to the embodiments, the image forming apparatus includes the control unit that also functions as a first image carrier drive control unit that obtains the cyclic speed fluctuation of the photosensitive element 11Y from the detection data detected by the pattern detecting sensor 40, and controls driving of the photosensitive element 11Y so as to reduce the speed fluctuation thereof. In this manner, the cyclic speed fluctuation of the photosensitive element 11Y is suppressed, and a positional deviation caused by the cyclic speed fluctuation of the photosensitive element 11Y can be suppressed in the image transferred from the photosensitive element 11Y onto the recording sheet P.

Furthermore, according to the embodiments, the interval in the rotating direction of the intermediate transfer belt between the primary transfer nip and the secondary transfer nip is set to a positive integral multiple of the circumferential length of the driving roller 8, which is one of the roller members stretching the intermediate transfer belt 12 and is at the same time a driving roller for driving the intermediate transfer belt 12 in rotation. In this manner, the speed fluctuation of the intermediate transfer belt 12 would be at the same phase at each of the primary transfer nip and the secondary transfer nip. Therefore, elongation or shrinkage of the image can be suppressed.

Furthermore, according to the embodiments, the interval between the primary transfer nips of the adjacent photosensitive elements 11Y, 11M, and 11Y which are arranged facing the outer surface of the intermediate transfer belt 12 is set to a positive integral multiple of the circumferential length of the driving roller 8, which is one of the roller members stretching the intermediate transfer belt 12 and at the same time is a driving roller for driving the intermediate transfer belt 12 in rotation. In this manner, color deviations in the toner images in Y, M, and C primarily transferred onto the intermediate transfer belt 12 can be suppressed.

In the embodiments, even if the direct transfer nip is arranged downstream of the secondary transfer nip in the recording sheet conveying direction, the same various advantageous effects can be achieved by using the various configurations and control techniques disclosed in the embodiments.

According to the present invention, the drive control unit controls driving of the driving roller to reduce the cyclic speed fluctuation of the recording medium carriage belt detected by the speed fluctuation detecting unit, so that the cyclic speed fluctuations occurring on the recording medium carriage belt can be suppressed. Therefore, a positional deviation in the images transferred onto the recording medium at the direct transfer position and at the secondary transfer position and caused by the cyclic speed fluctuation of the recording medium carriage belt can be suppressed regardless of the positional relation between the direct transfer position and the secondary transfer position. Furthermore, a limitation in the positional relation between the direct transfer position and the secondary transfer position, such as the limitation imposed on the image forming apparatus according to the previous application, is eliminated. Therefore, the interval between the direct transfer position and the secondary transfer position can be reduced so as to reduce the size of the image forming apparatus.

According to the present invention, a positional deviation in the images due to the cyclic speed fluctuations of the recording medium carriage belt can be suppressed, and the size of the image forming apparatus can be reduced as a result, advantageously.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a first image carrier;

a first image forming unit that forms an image on the first image carrier;

an intermediate transfer belt on which the image formed on the first image carrier is primarily transferred;

a primary transfer unit that primarily transfers the image formed on the first image carrier onto the intermediate transfer belt;

a secondary transfer unit that secondarily transfers the image transferred onto the intermediate transfer belt further onto a recording medium;

a second image carrier that is arranged upstream or downstream of a secondary transfer position, where the image is transferred from the intermediate transfer belt onto the recording medium, in a recording sheet conveying direction;

a second image forming unit that forms an image on the second image carrier;

a direct transfer unit that directly transfers the image formed on the second image carrier onto the recording medium;

a recording medium carriage belt that carries and conveys the recording medium to pass through a direct transfer position where the image is directly transferred from the second image carrier onto the recording medium, and carries and conveys the recording medium to the secondary transfer position, that is rotatably stretched across a plurality of roller members;

a driving roller that is one of the roller members that stretches the recording medium carriage belt, and that drives the recording medium carriage belt in rotation;

a speed fluctuation detecting unit that detects a cyclic speed fluctuation of the recording medium carriage belt; and a drive control unit that controls driving of the driving roller so as to reduce the cyclic speed fluctuation of the recording medium carriage belt based on a detection result of the speed fluctuation detecting unit, wherein:

the speed fluctuation detecting unit includes a pattern image detecting unit that detects a plurality of pattern images, which are formed on the second image carrier and then transferred onto the recording medium carriage belt, and that is arranged facing an outer surface of the recording medium carriage belt, the drive control unit obtains a speed fluctuation of the recording medium carriage belt at a rotation cycle of the driving roller based on detection data detected by the pattern image detecting unit, and controls driving of the driving roller so as to reduce the speed fluctuation, and an interval, which is along a rotating direction of the recording medium carriage belt between the direct transfer position and a detecting position of the pattern image detecting unit detecting the pattern images, is set so as not to be a positive integral multiple of a circumferential length of the driving roller.

2. The image forming apparatus according to claim 1, further comprising a second image carrier drive control unit that obtains a cyclic speed fluctuation of the second image carrier based on the detection data detected by the pattern image detecting unit, and that controls driving of the second image carrier so as to reduce the speed fluctuation.

3. An image forming apparatus comprising:

a first image carrier;

a first image forming unit that forms an image on the first image carrier;

an intermediate transfer belt on which the image formed on the first image carrier is primarily transferred;

a primary transfer unit that primarily transfers the image formed on the first image carrier onto the intermediate transfer belt;

a secondary transfer unit that secondarily transfers the image transferred onto the intermediate transfer belt further onto a recording medium;

a second image carrier that is arranged upstream or downstream of a secondary transfer position, where the image is transferred from the intermediate transfer belt onto the recording medium, in a recording sheet conveying direction;

a second image forming unit that forms an image on the second image carrier;

a direct transfer unit that directly transfers the image formed on the second image carrier onto the recording medium;

a recording medium carriage belt that carries and conveys the recording medium to pass through a direct transfer position where the image is directly transferred from the second image carrier onto the recording medium, and carries and conveys the recording medium to the secondary transfer position, and that is rotatably stretched across a plurality of roller members;

a driving roller that is one of the roller members that stretches the recording medium carriage belt, and that drives the recording medium carriage belt in rotation;

a speed fluctuation detecting unit that detects a cyclic speed fluctuation of the recording medium carriage belt; and a drive control unit that controls driving of the driving roller so as to reduce the cyclic speed fluctuation of the recording medium carriage belt based on a detection result of the speed fluctuation detecting unit, wherein:

the speed fluctuation detecting unit includes a pattern image detecting unit that detects a plurality of pattern images which are formed on the first image carrier and then transferred onto the recording medium carriage belt via the intermediate transfer belt, and that is arranged at a position facing an outer surface of the recording medium carriage belt, the drive control unit obtains a speed fluctuation of the recording medium carriage belt at a rotation cycle of the driving roller based on detection data detected by the pattern image detecting unit, and controls driving of the driving roller so as to reduce the speed fluctuation, and an interval, which is along a rotating direction of the recording medium carriage belt between the secondary transfer position and a detecting position of the pattern image detecting unit detecting the pattern images, is set so as not to be a positive integral multiple of a circumferential length of the driving roller.

4. The image forming apparatus according to claim 3, further comprising a first image carrier drive control unit that obtains a cyclic speed fluctuation of the first image carrier based on the detection data detected by the pattern image detecting unit, and that controls driving of the first image carrier so as to reduce the speed fluctuation.

5. The image forming apparatus according to claim 4, wherein an interval, along a rotating direction of the intermediate transfer belt between a primary transfer position and the secondary transfer position, is set to a positive integral multiple of a circumferential length of an intermediate transfer belt driving roller that is one of a plurality of roller members stretching the intermediate transfer belt and drives the intermediate transfer belt in rotation.

6. The image forming apparatus according to claim 5, wherein an interval, which is between primary transfer positions of adjacent image carriers amongst a plurality of image carriers including the first carrier and arranged facing the outer surface of the intermediate transfer belt, is set to be a positive integral multiple of a circumferential length of an intermediate transfer belt driving roller that is one of a plurality of roller members stretching the intermediate transfer belt and drives the intermediate transfer belt in rotation.

7. The image forming apparatus according to claim 4, wherein an interval, which is between primary transfer positions of adjacent image carriers amongst a plurality of image carriers including the first carrier and arranged facing the outer surface of the intermediate transfer belt, is set to be a positive integral multiple of a circumferential length of an intermediate transfer belt driving roller that is one of a plurality of roller members stretching the intermediate transfer belt and drives the intermediate transfer belt in rotation.

8. The image forming apparatus according to claim 3, wherein an interval, along a rotating direction of the intermediate transfer belt between a primary transfer position and the secondary transfer position, is set to a positive integral multiple of a circumferential length of an intermediate transfer belt driving roller that is one of a plurality of roller members stretching the intermediate transfer belt and drives the intermediate transfer belt in rotation.

9. The image forming apparatus according to claim 8, wherein an interval, which is between primary transfer positions of adjacent image carriers amongst a plurality of image carriers including the first carrier and arranged facing the outer surface of the intermediate transfer belt, is set to be a positive integral multiple of a circumferential length of an intermediate transfer belt driving roller that is one of a plurality of roller members stretching the intermediate transfer belt and drives the intermediate transfer belt in rotation.

10. The image forming apparatus according to claim 3, wherein an interval, which is between primary transfer positions of adjacent image carriers amongst a plurality of image carriers including the first carrier and arranged facing the outer surface of the intermediate transfer belt, is set to be a positive integral multiple of a circumferential length of an intermediate transfer belt driving roller that is one of a plurality of roller members stretching the intermediate transfer belt and drives the intermediate transfer belt in rotation.

* * * * *